US008187114B2

(12) United States Patent
Cirincione

(10) Patent No.: US 8,187,114 B2
(45) Date of Patent: May 29, 2012

(54) GOLF BACK-BOARD

(76) Inventor: Russell Joseph Cirincione, Staten Island, NY (US)

( * ) Notice: Subject to any disclaimer, the term of this patent is extended or adjusted under 35 U.S.C. 154(b) by 195 days.

(21) Appl. No.: 12/586,810

(22) Filed: Sep. 29, 2009

(65) Prior Publication Data

US 2011/0237341 A1 Sep. 29, 2011

Related U.S. Application Data

(60) Provisional application No. 61/105,887, filed on Oct. 16, 2008.

(51) Int. Cl.
*A63B 69/36* (2006.01)

(52) U.S. Cl. ..... 473/180; 473/175; 473/179

(58) Field of Classification Search ..... 473/173–189; 229/4.5, 106, 109; 40/124.14–124.19
See application file for complete search history.

(56) References Cited

U.S. PATENT DOCUMENTS 1,683,875 A * 9/1928 Duffy et al. ..... 473/180
1,773,813 A * 8/1930 Gourlay et al. ..... 473/185
1,997,429 A * 4/1935 Eaton ..... 229/102.5
2,031,525 A * 2/1936 Clarke ..... 473/180
2,068,763 A * 1/1937 Powell ..... 229/107
2,078,038 A * 4/1937 Walter ..... 229/102.5
2,462,420 A * 2/1949 Pinder ..... 473/180
2,574,927 A * 11/1951 Mastin ..... 229/117.18
2,716,029 A * 8/1955 Montgomery ..... 473/184
2,938,729 A * 5/1960 Billfaldt ..... 473/180
3,033,571 A * 5/1962 Botts ..... 273/127 D
4,054,001 A * 10/1977 De Pinna ..... 40/539
4,396,194 A * 8/1983 Seiferth ..... 473/187
4,573,686 A * 3/1986 Nakamats ..... 473/184
5,087,046 A * 2/1992 Mauch ..... 473/180
5,518,168 A * 5/1996 Mayer ..... 229/102
5,755,376 A * 5/1998 Greer et al. ..... 229/107
6,364,201 B1 * 4/2002 Varano ..... 229/198.2
6,561,414 B1 * 5/2003 Cai ..... 229/400
6,638,174 B1 * 10/2003 Ford ..... 473/184
7,914,387 B1 * 3/2011 Gugliotti ..... 473/174
2002/0173366 A1 * 11/2002 Lister ..... 473/174

* cited by examiner

*Primary Examiner* — Mark Graham

(57) ABSTRACT

A one piece, golf accessory formed from a flexible thin flat plastic sheet which assembles into a three dimensional golf target structure and maybe disassembled. The three dimensional golf target structure includes a rounded cup with a backboard above it having wings extending to either side of the cup capable of guiding a golf ball to the cup. The wings each have a ground insertion spike to hold them in position on the ground above the cup. The cup has a bottom to capture a golf ball. The is cup sized and designed to fit into a regulation sized golf hole with a target on the center of the backboard for a golfer to aim at.

15 Claims, 17 Drawing Sheets

GOLF BACK-BOARD

This application claims priority from provisional patent 61/105,887 filed on Oct. 16, 2008.

DECLARATION

The Golf BackBoard is intended to act as a putting training accessory.

The Golf BackBoard will be used as a ball retriever

The target of the Golf BackBoard can be seen from a good distance.

It can also be used as a new way to play golf with the assistance of this putting device.

Training will be in the areas as follows:

| | |
|---|---|
| Distance | Depth Perception |
| Speed Control | Positive enforcement |
| Accuracy | |

The Golf BackBoard will fit into any regulation golf hole on any practice or course green in the world. It can be used on a 'do-it-yourself' practice green. It can be rotated around any hole for ease of multiple movements and practice from different angles on the same putting surface. It can be used in several putt training, and ball return devices already on the market.

The opening faces the player and the direction of the golf ball. This can be moved around the hole for practice over different obstacles and lies. In play, it is used the same way as on the practice green. The opening faces the direction of the golf ball in play. For a foursome, as 1 player putts-out, that player will retrieve their ball and reposition the Golf Back-Board for the next player.

For example: As normal play, after all 4 players have landed their balls on the green, the player furthest away from the hole putts first. This player will putt till they sink their ball, retrieve their ball and reposition the Golf BackBoard for the next furthest player. The next furthest player then putts. This player will sink their putt retrieve their ball and reposition the Golf BackBoard for the third player, till the end. The last player will remove the Golf BackBoard from the hole and carry it to the following hole.

The Golf BackBoard is portable and intended to travel easily from hole to hole. Using a common clip, it can be attached to any golf bag, golf cart or a golfer's belt. It can be inserted and removed from the golf hole easily. When done, it folds flat easily and slips into any side pocket of any golf bag on the market.

FIGURE SPECIFICATION

Figure 1:
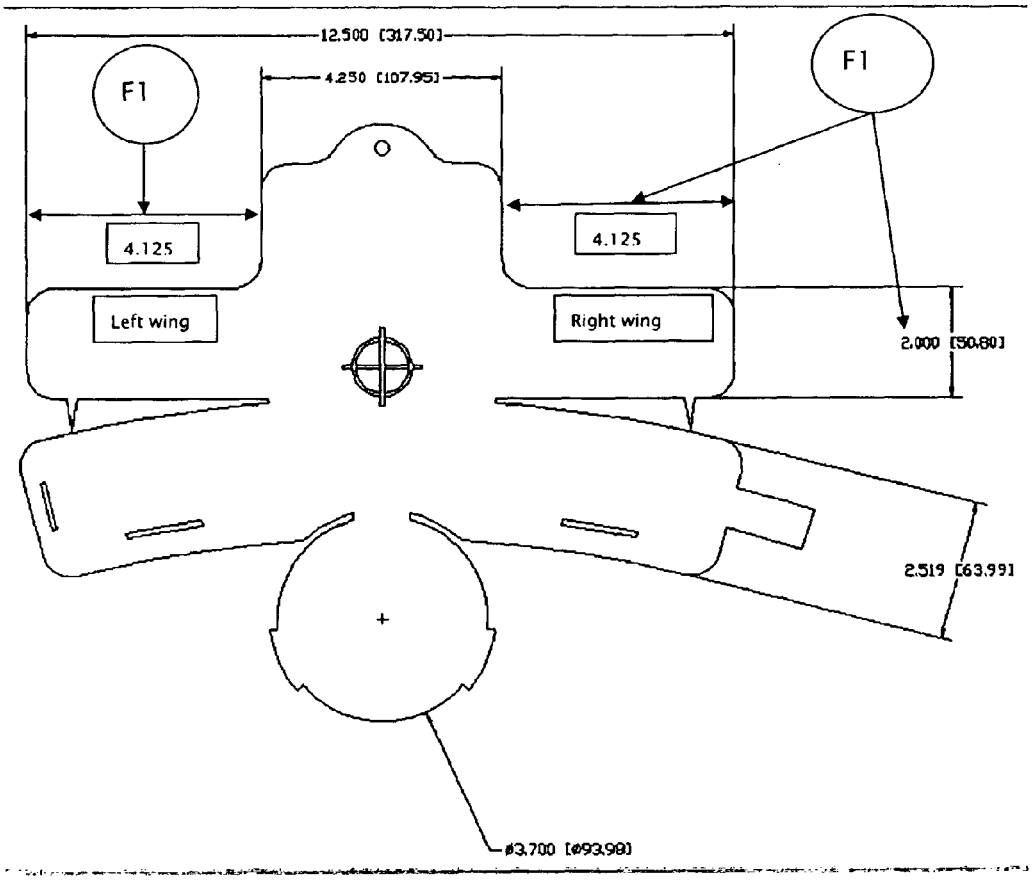

FIG. 1—Right and left wings—these measure 4.125 inches in width each and 2 inches in height and 4.125 inches in width each. Each corner is rounded to a 90 degree angle. Once the Golf Back Board is inserted into the golf hole, the wings will sit on top of the putting surface and provide a targetguide for the golfer to putt towards ball to the golf hole path. These wings can be left naturally perpendicular to the direction of the golf ball putt line or bent inward more to allow for a better angle to guide the ball into the cup.

Figure 2:
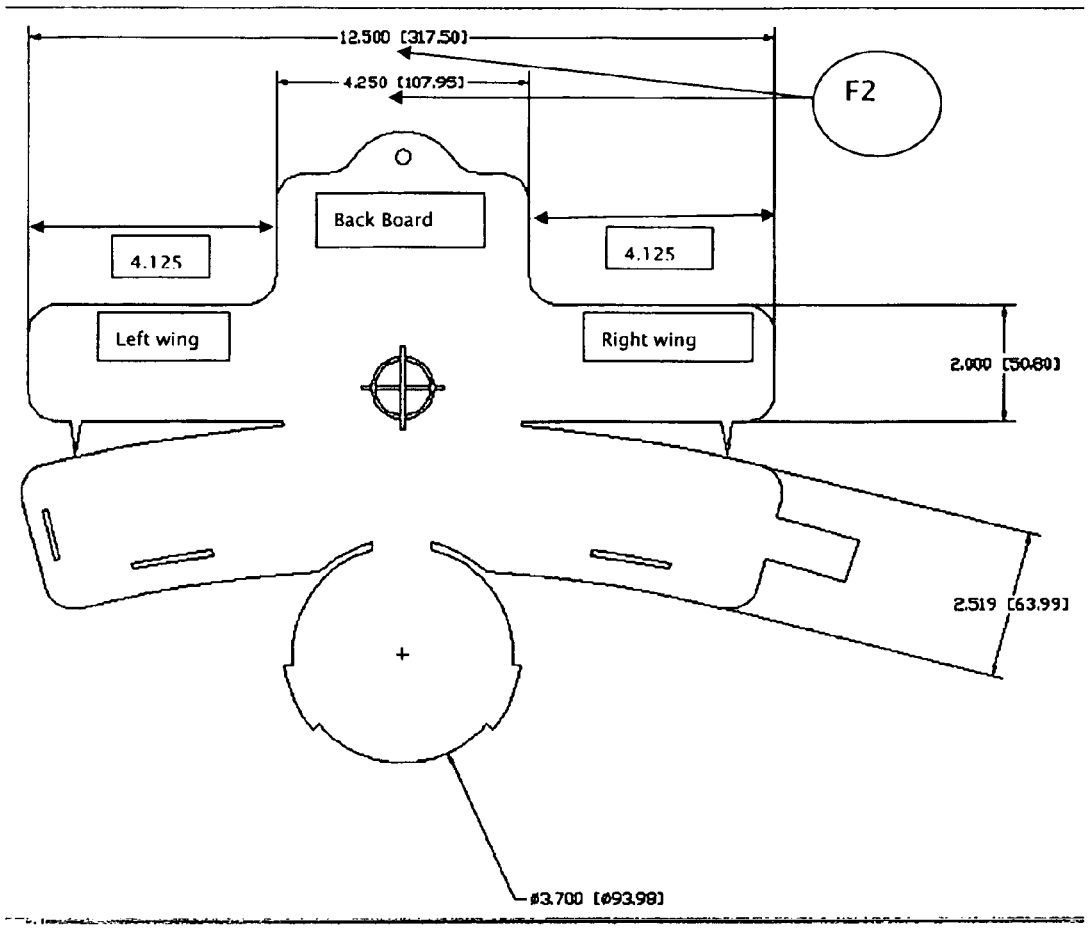

FIG. 2—The Back-Board—The width of the back board is 4.25 inches. The two wing sections join to the sides of the Back-Board. The top of the back board corners are rounded to 90 degrees. The top line on the right and left have an upward curve and join at the center of the back board. These curves have a ¾ inch high elevation of the top line. Here at the center is a A inch hole for attaching a clip or hanging device.

Figure 3:
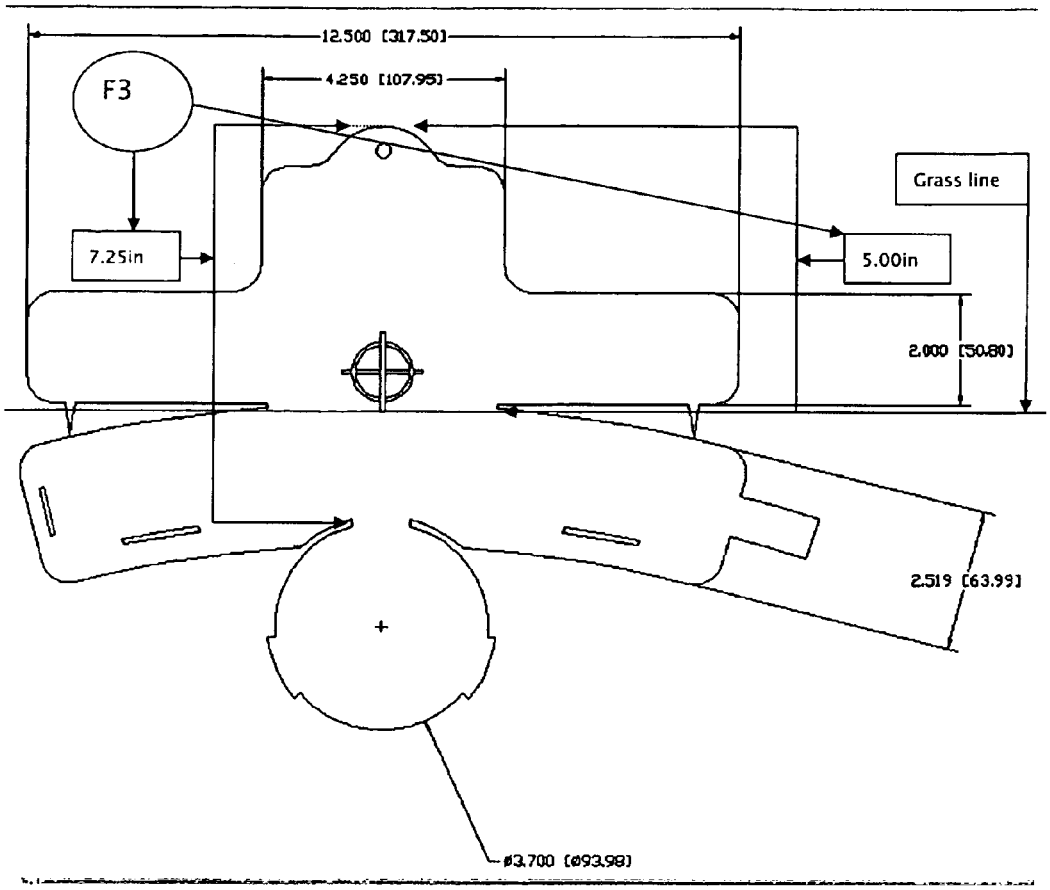

FIG. 3—The Golf Back Board stands 7.25 inches tall when assembled and at rest on a flat surface. When in play and in place in a golf hole, the Golf Back Board stands 5.00 inches above the grass line.

Figure 4:
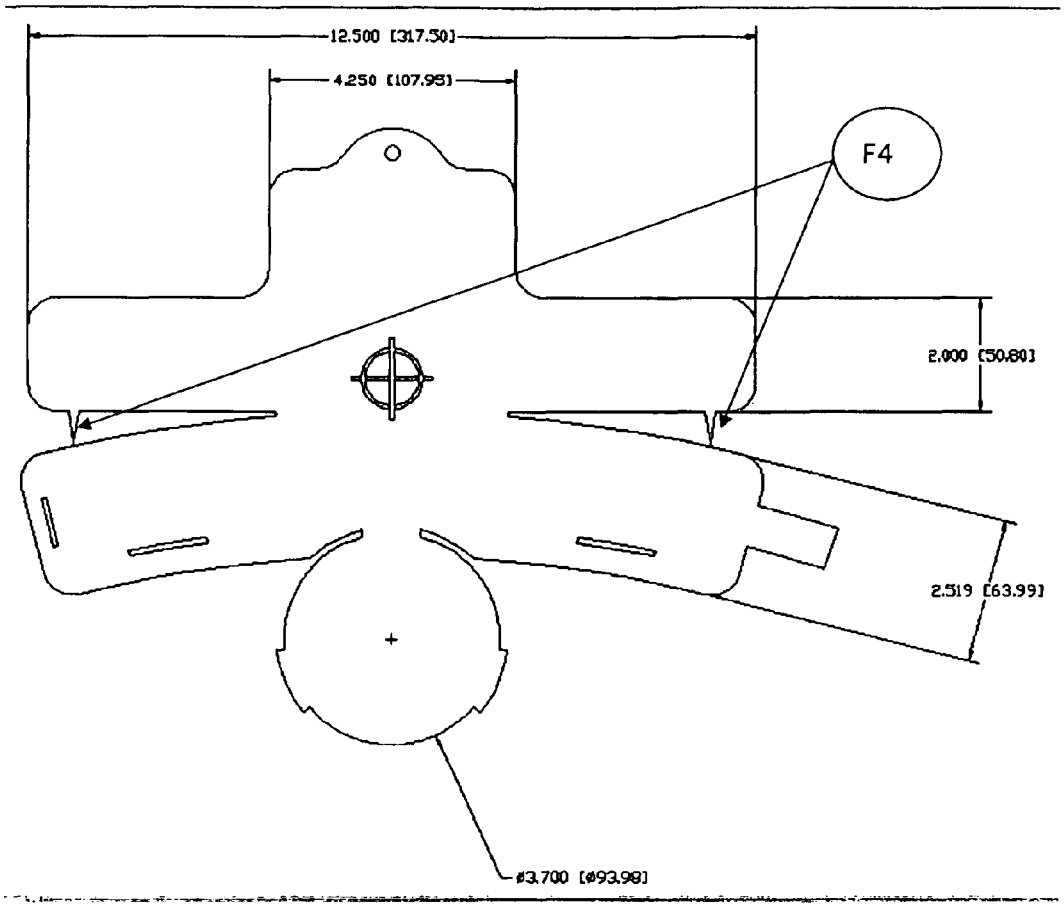

FIG. 4—Stabilizing Customization Stakes—One inch off the right and left wing tips are stakes that are intended to be pushed into the grass putting surface. These stakes are ½ inch long. In addition to providing stabilization, these will allow the user to customize the arch of the wings to guide the ball in the direction of the cup. During practice, when the ball should strike the wing, at an acceptable speed, the arch angle will direct the ball into the cup for the completion of the practice drill.

Figure 5:
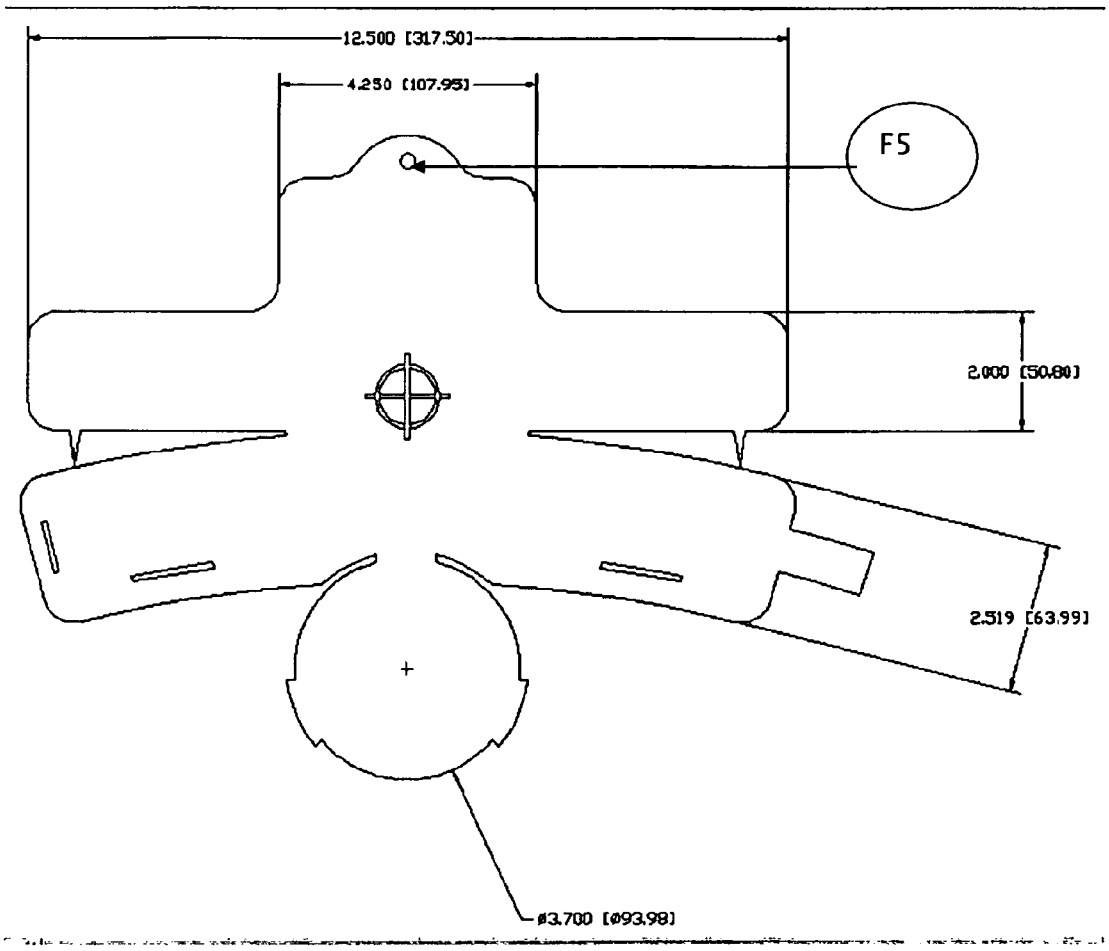

FIG. 5—Clip Hole—In the upper center of the Back Board is a hole punch for use by the owner. A clip can be inserted so the Golf Back Board can be clipped to any article—such as a golf bag or pants belt loop. The diameter of this hole is 0.75 of an inch.

Figure 6:
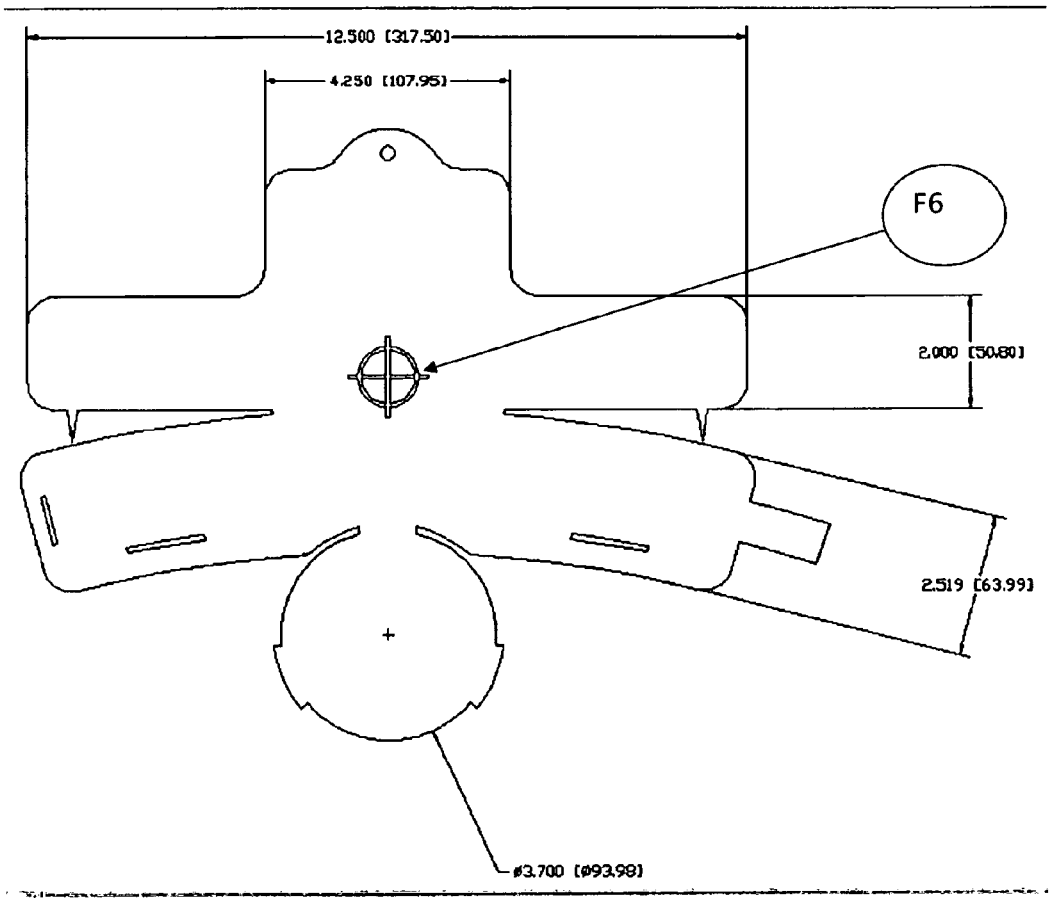

FIG. 6—Center Target—In the center of the Golf Back Board is an actual target or cross-hair to be used as a visual target. This target lies just above ground level.

Intended as use 1—As a true Back Board, this is the central point to the Golf Back Board. As a ball stop the training device is intended to allow practice of a stronger putting so the golfer builds the feel for distance, depth and club head speed. With the repetitive use of the Golf Back Board, the golfer will train their muscles for accurate putting.

Intended as use 2—The entire back board section can be used as a ball retriever. In actual use, once the golf ball or balls are in the cup, the golfer need only grasp the central top position of the back-board and lift the entire device out of the hole. This allows the golfer to reach not less than 5 inches above ground level to retrieve the golf balls. In normal practice, the golfer would need to bend more than 5 inches below ground level—5 inched below their feet—to get the ball out from the bottom of the cup. This is an enhancement for the older golfer or the golfer with lower back issues.

Intended as use 3—The entire width of the back board and wings can be used as advertizing space. Companies will be able to add branding to this area under a separate license of marketing agreement.

Figure 7:
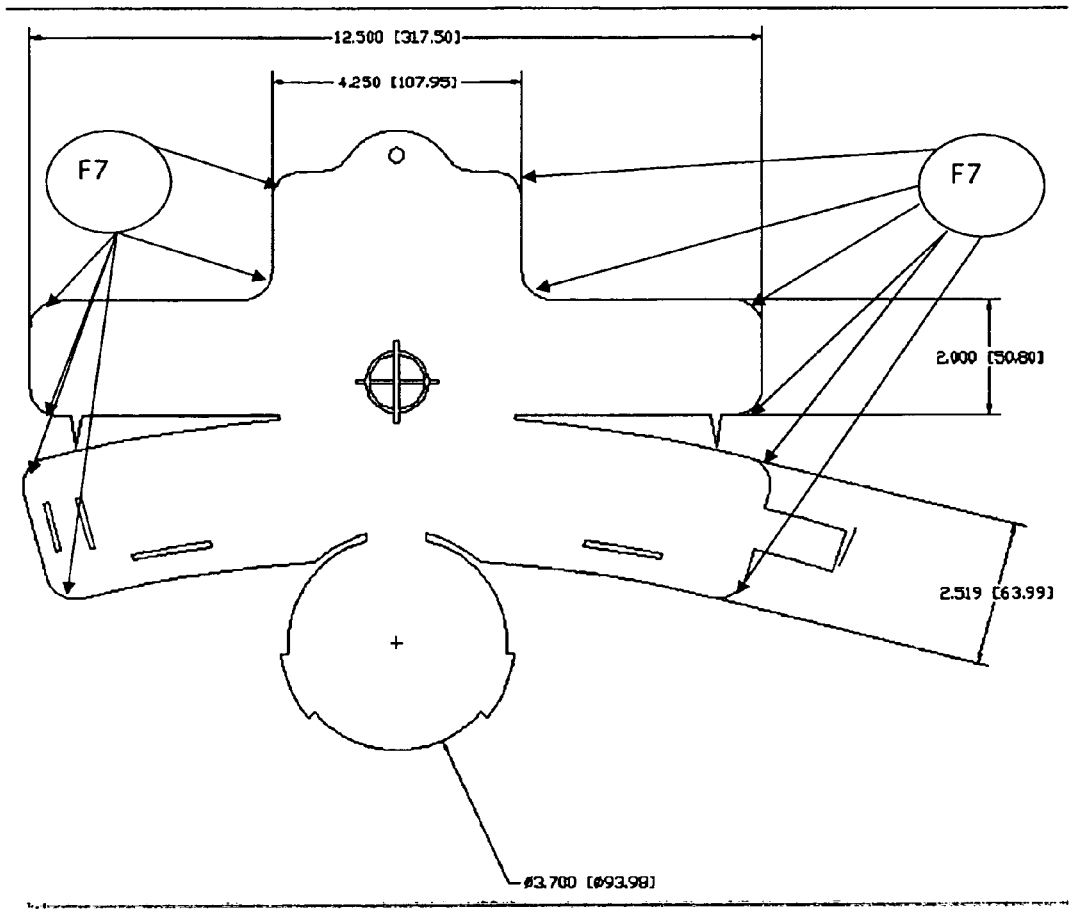

FIG. 7—Corners and sharp edges—There are no sharp edges on the Golf Back Board. All corners are rounded to a 90 degree angle so not to catch any articles or scratch any golfer.

Figure 8A:
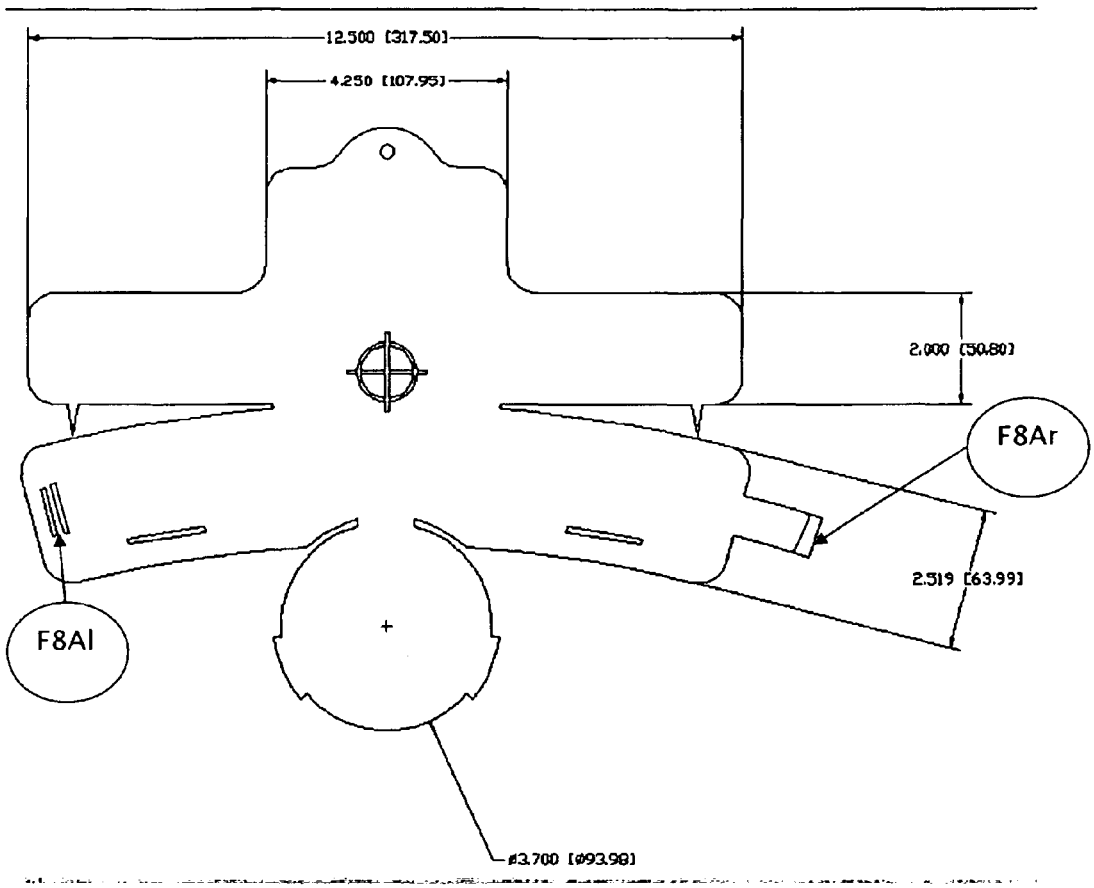

FIG. 8A—The cup is formed by inter locking the right left male tab (F8Al) (0.75 inches height by 1.25 inches long) with the left female slot (F8Al) (0.75 inches height by 0.50 inches wide) to close the outside walls of the cup. The lock is molded with out-dents (2) and catches to hold the lock in place and to allow secure but moveable and sturdy locking of the right side and left side of the cup walls. The cup bottom will be held as a complete circle by the tension of this lock. This will secure the complete bottom detail of the Golf Back Board.

Figure 8B:
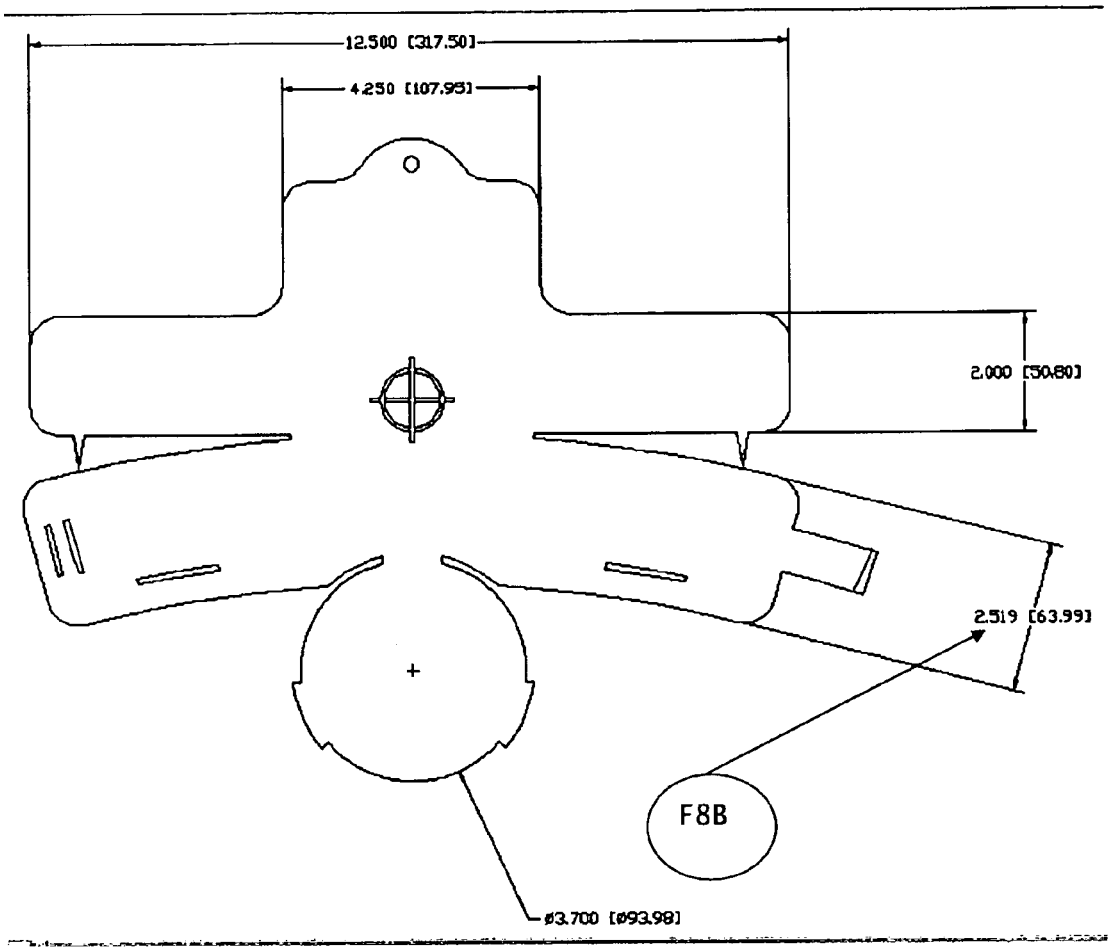

FIG. 8B—The height of the lower section is 2.519 inches detail

Figure 8C:
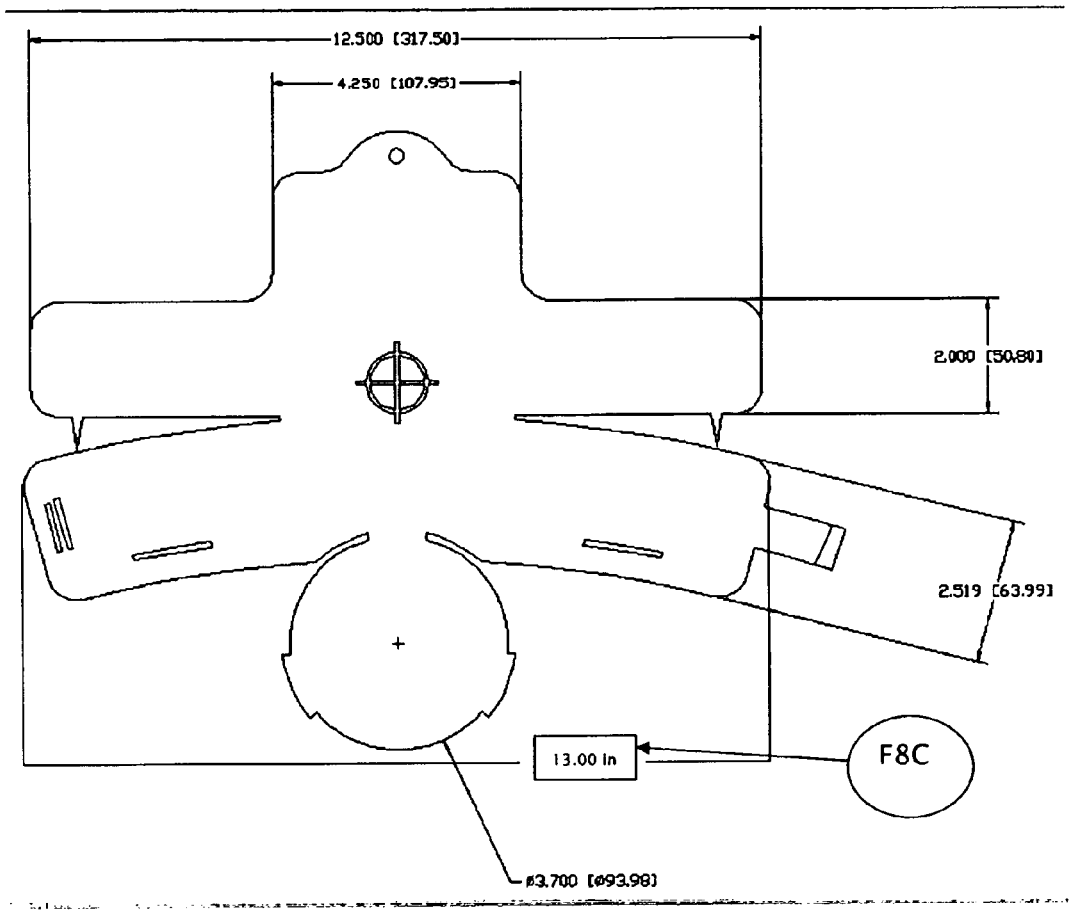

FIG. 8C—The width of the lower section is 13 inches. The closed cup walls and the cup bottom, when assembled, fit into the golf cup on the practice range or the golf course. This will hold 3-4 golf balls that land in the cup.

Figure 8D:
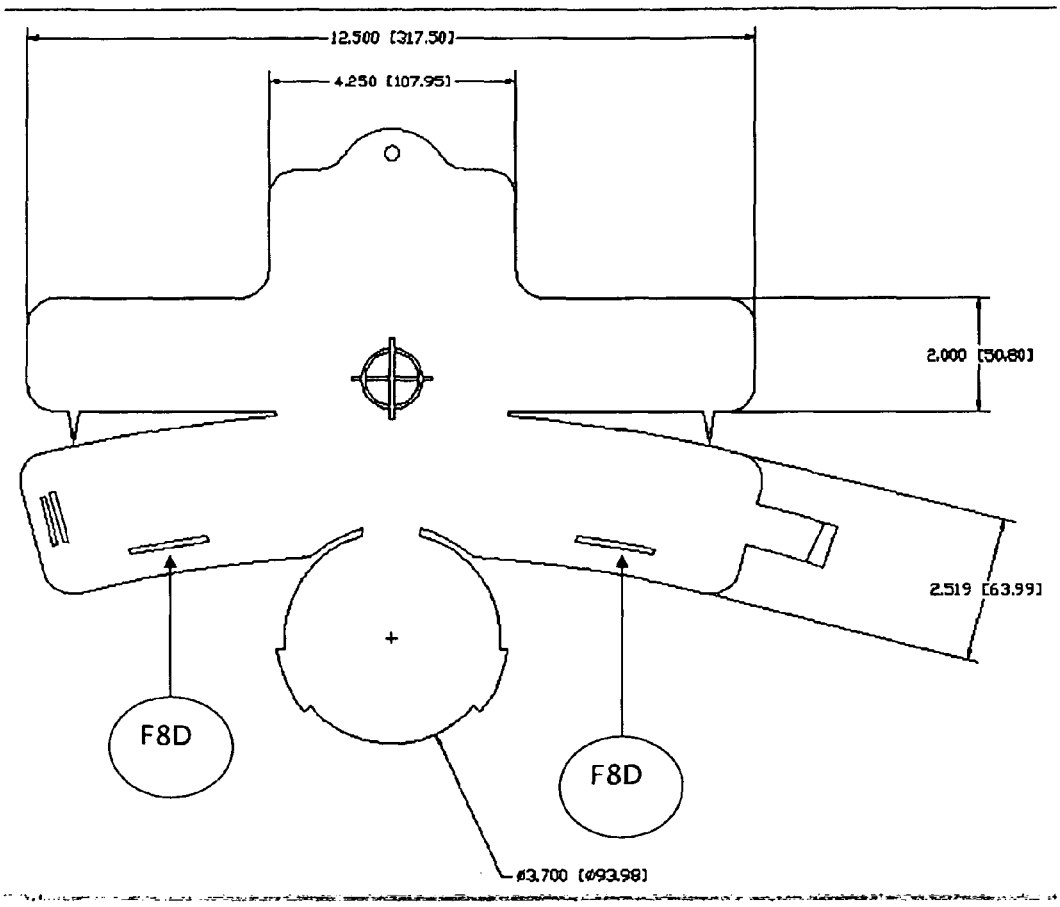

FIG. 8D—There are two slots/cut outs in the lower section walls. These are used to hold the cup bottom in place when completely assembled. These are 1.375 inches off the outside tips and measure 1.25 inches in length and 1/16 of an inch in height. The cup bottom will slip into these slots.

Figure 8E:
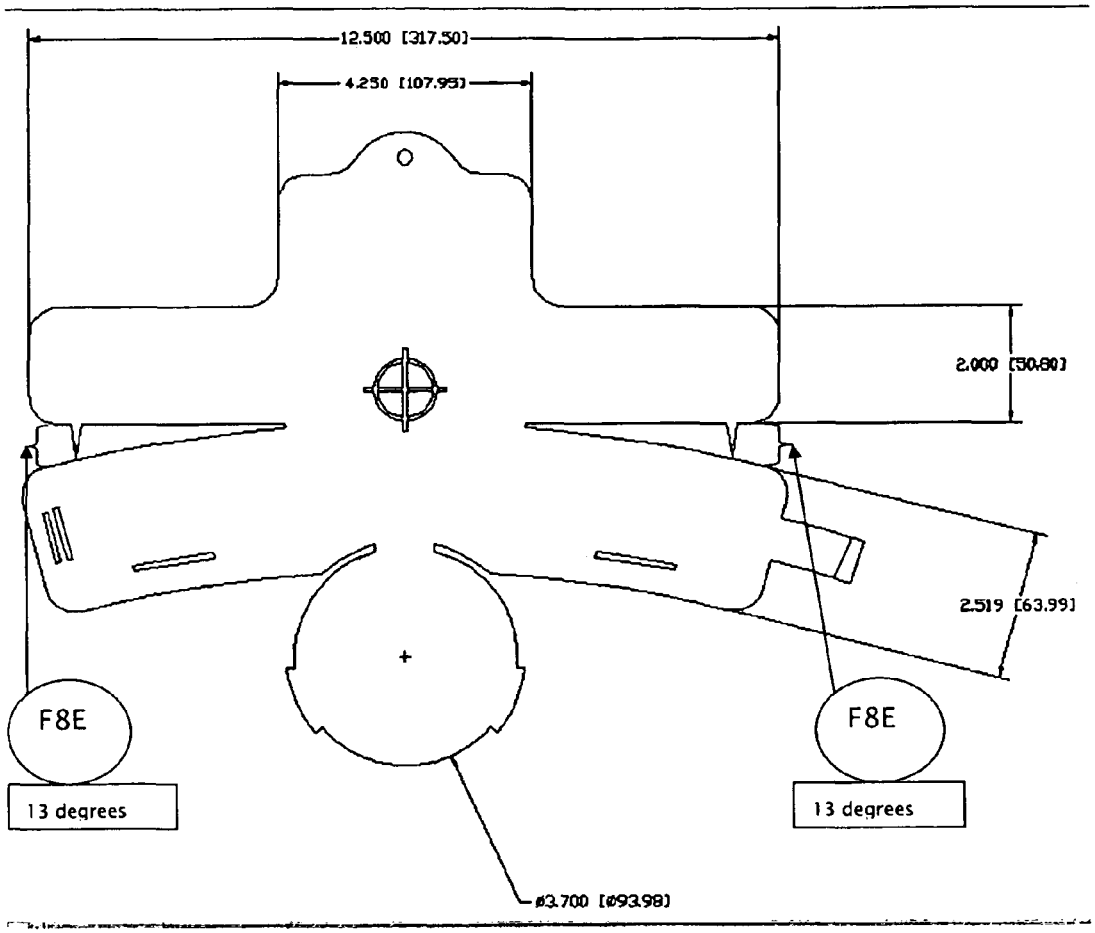

FIG. 8E—As per the design, the flat view shows the lower section built with a slight arch. The angle of this arch is 13 degrees at the right and left most tips. This allows the lower section to take on a tapered cup form when locked in place. This will allow easy insertion and removal of the Golf Back Board in the regulation cup during practice and play. With this tapering, the lower section of the Golf Back Board will sit just below ground level and not be in the path of the golf ball.

Figure 9:
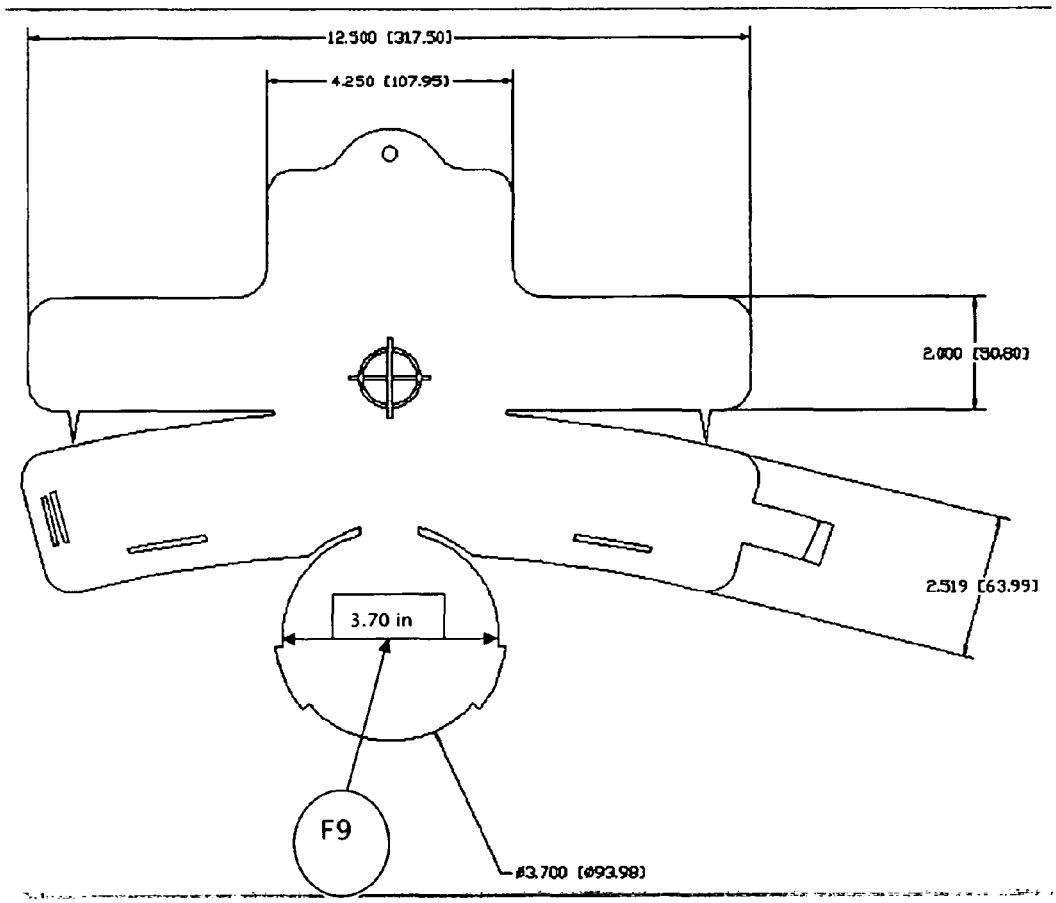

FIG. 9—Bottom-Cup bottom is 3.70 inches in diameter. This is a molded extension of the actual back board. The bottom has the patient number, web site address—GolfBack Board.com engraved.

Figure 9A:
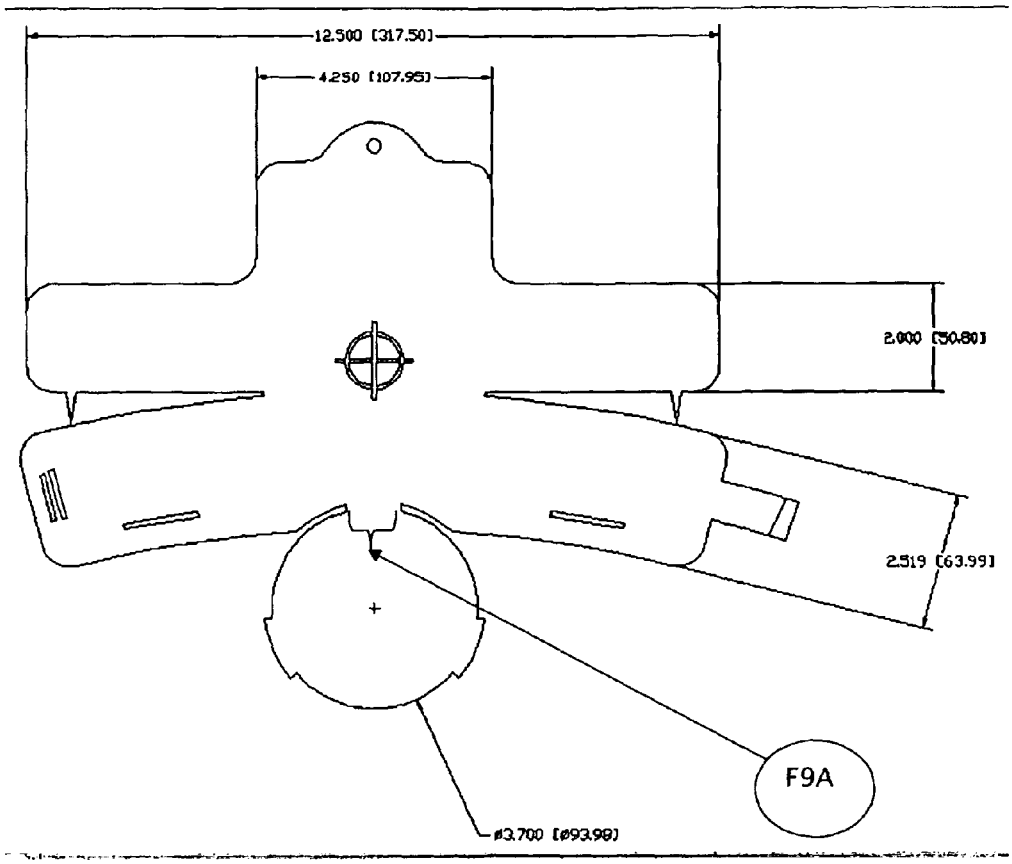

FIG. 9A—Hinge operation—the connection point between the bottom of the back board section and the cup bottom will act as a hinge. When folded up at a 90 degree angle and interlocked this connection point will act as a hinge.

Figure 9B:
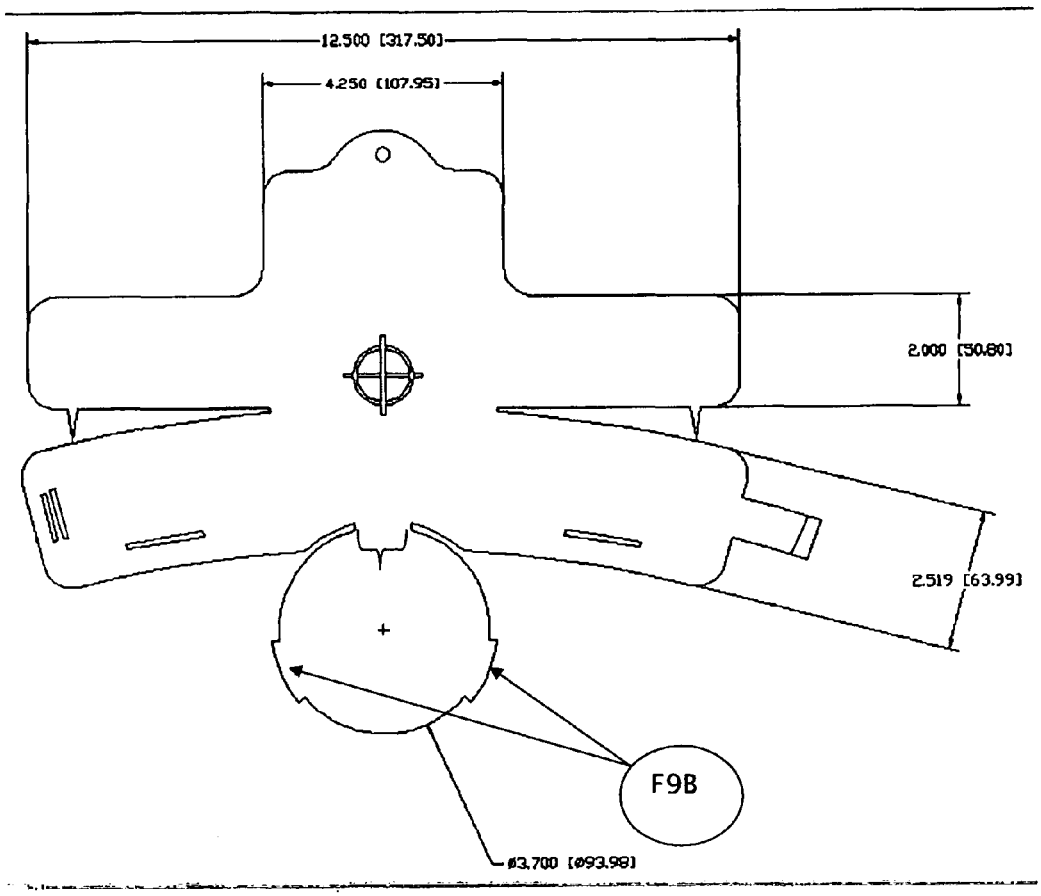

FIGS. 9B-C*up* bottom tabs—On each side of the cup bottom there are tabs molded to fit into the side walls (see Detail FIG. 8D above). These tabs will support the weight of 5 golf balls. The bottom is held in place by the combination of the tabs and the locking mechanism. These are 1 3/16 of an inch wide and have the arch of the cup.

Figure 10:
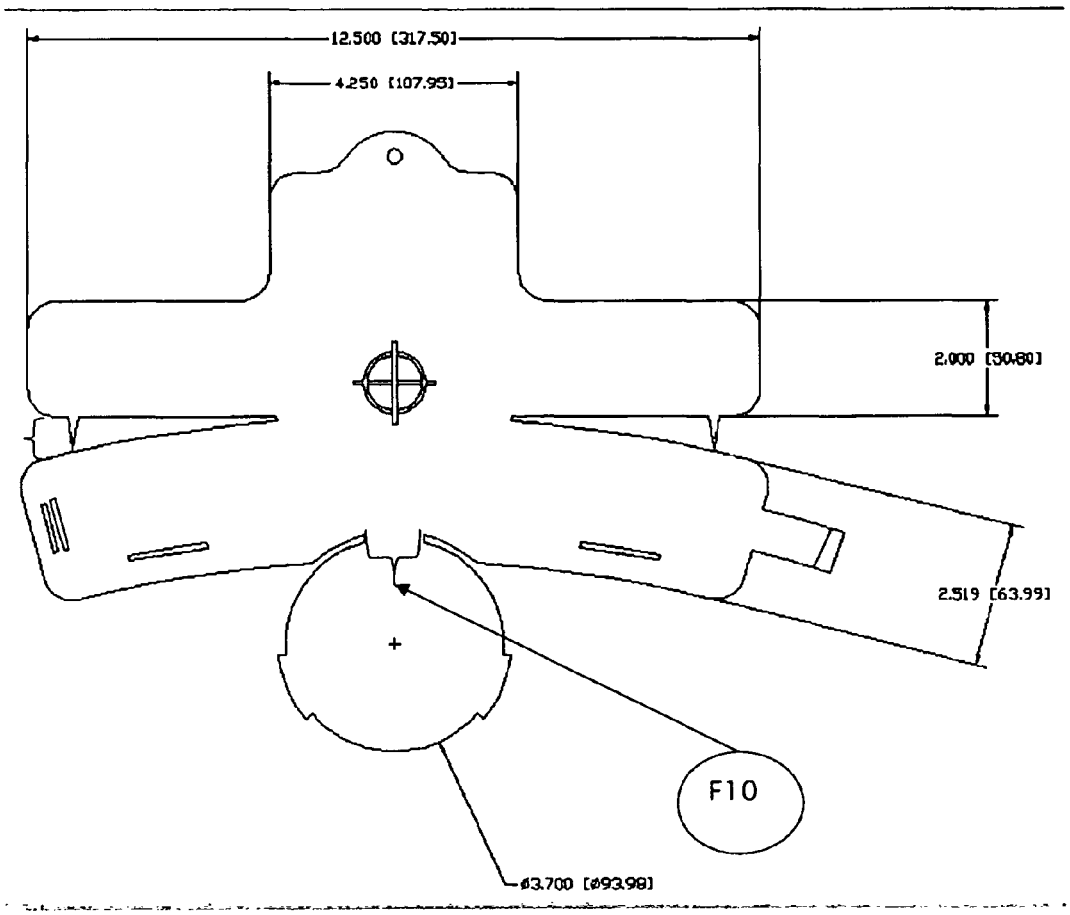

FIG. 10—Hinge connection—is the molded connection between the Golf Back Board and the cup bottom. This connection (hinge) is 1 inch wide. This will allow the bottom to be kept flat for storage or stay in position when in use. This is intended to be a 90 degree angle elbow bending of the plastic.

Figure 11:
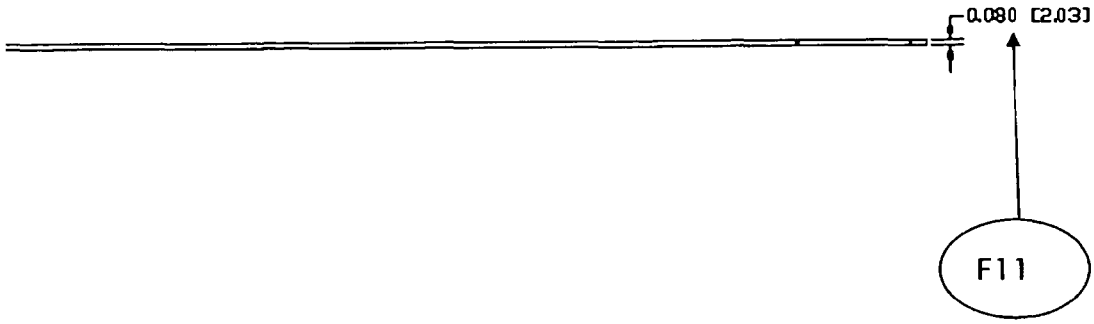

FIG. 11—The thickness of the Golf Back Board is 0.08 cm.

| | |
|---|---|
| FIG. 1 | Right, Left Wing - each measure 4.125 inches wide and 2 inches high. |
| FIG. 2 | Back board - the back board measures 4.25 inches wide. |
| FIG. 3 | Back Board - the back board measures 7.25 inches in height. The actual back board, when in position is 5 inches above the grass line. |
| FIG. 4 | Stabilizing spikes - One inch off each bottom corner of the right and left wing, 0.5 inches tall. |
| FIG. 5 | Center hole punch to attach carrying clip - 3/4 of an inch in diameter. See page 15. |
| FIG. 6 | Target crosshairs - circle is 1.25 round and crosshairs are 1.75 inches long each. |
| FIG. 7 | All corners are rounded to a 90 degree angle. |
| FIG. 8A | Male tab measures .75 of an inch tall and 1.25 inches long. Female slot measures .75 of an inch tall and .50 inch wide. |
| FIG. 8B | Cup wall height - The height of the cup wall is 2.519 inches. |
| FIG. 8C | Cup wall width - The width of the lower section is 13 inches. |
| FIG. 8D | Cup tab slots - are 1 3/8 inches off the outside tips of the cup wall section and measure 1.25 inches in length and 1/16 of an inch in height. |
| FIG. 8E | Angle of lower cup walls to provide the tapered fit for the golf hole. Wing section to cup wall angle at tips is 13 degrees. |
| FIG. 9 | Cup Bottom is 3.700 inches in diameter. |
| FIG. 9a | Hinge - a 90 degree angle to the Golf Back Board. |
| FIG. 9b | Cup bottom tabs - 2 tabs - 1 3/16 inches wide. |

-continued

| | |
|---|---|
| FIG. 10 | Cup bottom is connected to the cup body by the hinge. Hinge measures 1 inch wide. |
| FIG. 11 | The thickness of the finished plastic is 0.08. cm. |

The invention claimed is:

1. A one piece, golf accessory comprising, a flexible thin flat plastic sheet which assembles into a three dimensional golf target structure and disassembles into said flat plastic sheet, said three dimensional golf target structure including a rounded cup with a backboard above it, said backboard having wings extending to either side of said cup capable of guiding a golf ball to said cup, said wings each having a ground insertion spike to hold said wings in position on the ground above said cup, said cup having a bottom to capture a golf ball, said cup sized to fit into a regulation sized golf hole, and a target on the center of the backboard for a golfer to aim at.

2. The golf accessory of claim 1 wherein the plastic is polypropylene.

3. The golf accessory of claim 1 wherein the sheet is 0.08 cm thick.

4. The golf accessory of claim 1 wherein the wings are 4.125 inches wide and two inches tall.

5. The golf accessory of claim 1 wherein the sheet when lying flat has a width of 13 inches.

6. The golf accessory of claim 1 wherein the spikes are 0.5 inches long and 1.0 inches from a tip of the wing.

7. The golf accessory of claim 1 wherein a hole is provided at the center top of the backboard for an attachment clip.

8. The golf accessory of claim 1 wherein the target is a cross-hair.

9. The golf accessory of claim 1 wherein the cup has a depth of 2.519 inches.

10. The golf accessory of claim 1 wherein the cup is formed by a lower section of the sheet having a tab on one side and a slot on the other side which are connectable to one another to form the cup.

11. The golf accessory of claim 10 wherein the tab has a pair of ridges to lock the tab to the slot.

12. The golf accessory of claim 1 wherein the bottom of the cup has a diameter of 3.6875 inches.

13. The golf accessory of claim 10 wherein the cup bottom is attached at a hinge to the lower section.

14. The golf accessory of claim 10 wherein the cup bottom has two tabs that fit into slots in the lower section.

15. The golf accessory of claim 1 wherein the lower section curves away from the portion of the sheet forming the backboard by 13 degrees when the sheet is in the disassembled condition.

* * * * *